United States Patent [19]

Absher

[11] 4,389,155

[45] Jun. 21, 1983

[54] TRACTOR SCOOP MECHANISM

[76] Inventor: Charles A. Absher, Rte. 1, Box 210-B, Traphill, N.C. 28695

[21] Appl. No.: 262,125

[22] Filed: May 11, 1981

[51] Int. Cl.[3] ..... E02F 3/82

[52] U.S. Cl. ..... 414/723; 414/703

[58] Field of Search ..... 292/5, 33, 34, 36, 37; 414/703, 723, 697, 717; 280/808; 172/272–275

[56] References Cited

U.S. PATENT DOCUMENTS

| | | | |
|---|---|---|---|
| 1,964,114 | 6/1934 | Gerlach et al. | 292/36 |
| 2,188,532 | 1/1940 | Dominguez | 70/145 |
| 2,482,286 | 9/1949 | Mott | 414/703 |
| 2,721,404 | 10/1955 | Luke | 414/703 X |
| 2,788,138 | 4/1957 | Stueland | 414/703 |
| 2,812,082 | 11/1957 | Meldahl | 414/703 |
| 2,930,151 | 3/1960 | Brundage | 414/703 X |
| 3,181,903 | 5/1965 | Olander | 292/5 |
| 3,536,222 | 10/1970 | Patnode | 414/703 |
| 3,876,091 | 4/1975 | MacDonald | 414/723 |
| 3,912,092 | 10/1975 | Bolton et al. | 414/703 X |
| 4,030,624 | 6/1977 | Matthews | 414/723 |
| 4,042,141 | 8/1977 | Schweigert | 414/703 |
| 4,068,774 | 1/1978 | Howell | 414/703 |
| 4,256,337 | 3/1981 | Wappler | 414/723 X |

FOREIGN PATENT DOCUMENTS

| | | | |
|---|---|---|---|
| 970559 | 7/1975 | Canada | 414/723 |

OTHER PUBLICATIONS

U.S. Patent Application Serial No. 236,799 filed Feb. 23, 1981.

Drawing of Dump Device, dated Oct. 24, 1979.

*Primary Examiner*—Robert J. Spar

*Assistant Examiner*—Terrance L. Siemens

[57] ABSTRACT

The present specification discloses a tractor scoop mechanism which is connected to the rear hydraulic arms of a tractor and pivotally to a tractor scoop. The tractor scoop can then be dumped by pulling the handle on the scoop mechanism which releases the scoop by rotating locking pins from an engaged position and allows the scoop to pivot downwardly into a dumping posture.

7 Claims, 8 Drawing Figures

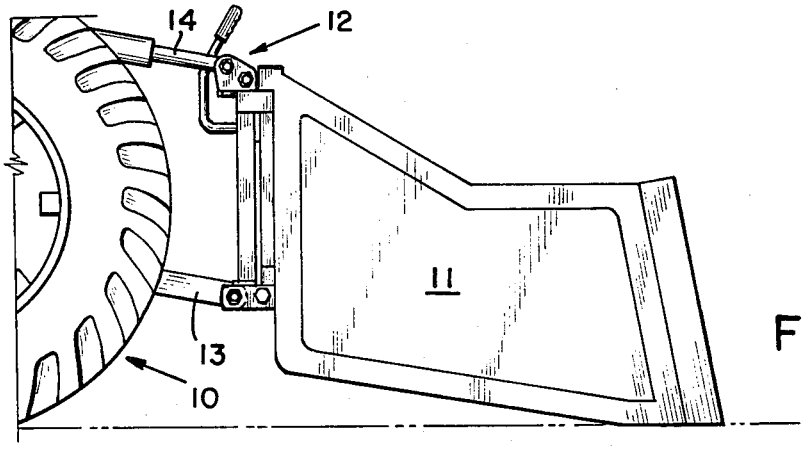
FIG. 1
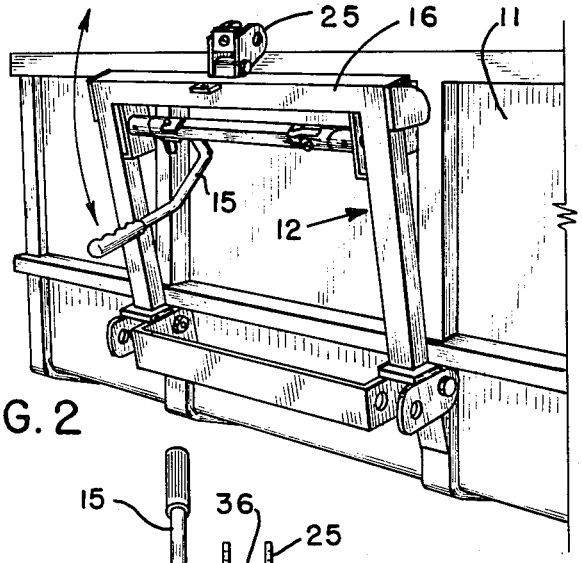
FIG. 2
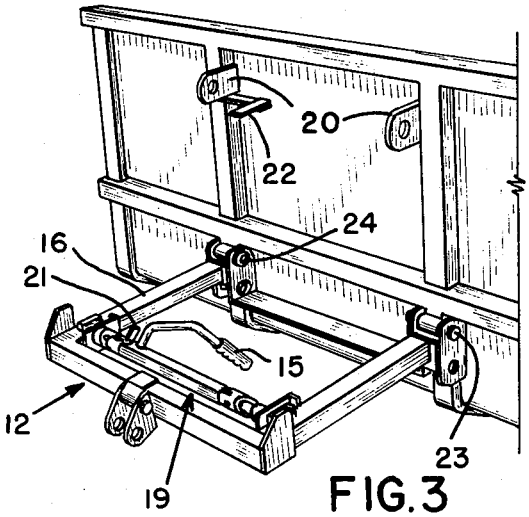
FIG. 3
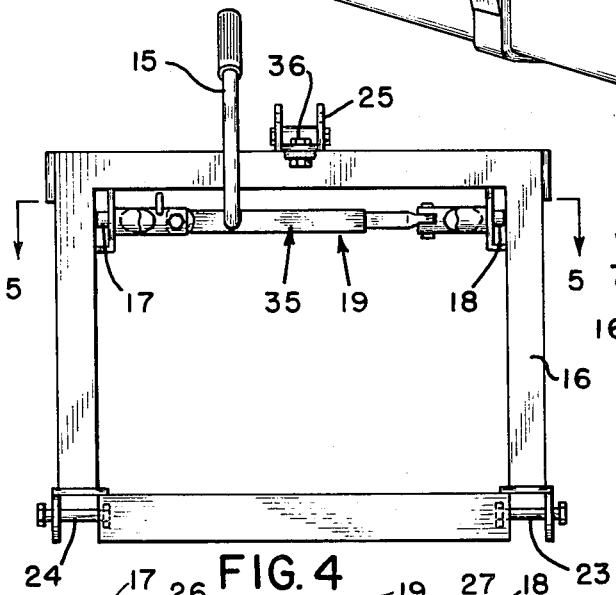
FIG. 4
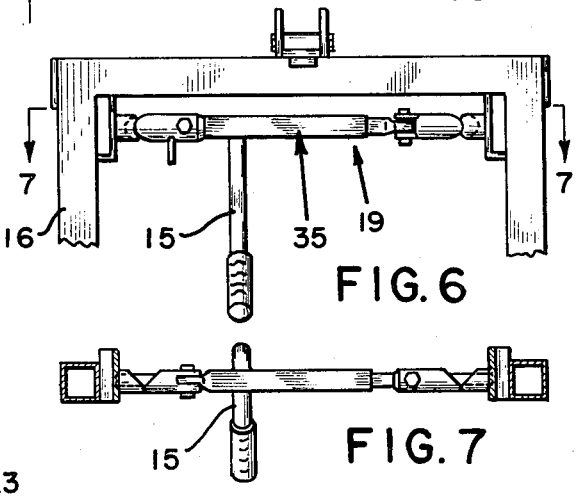
FIG. 6
FIG. 7
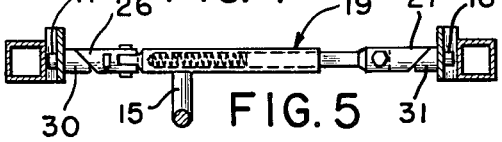
FIG. 5
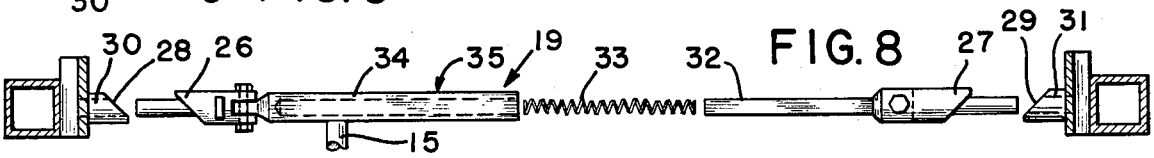
FIG. 8

TRACTOR SCOOP MECHANISM

BACKGROUND AND OBJECTIVES OF THE INVENTION

Rear mounted tractor scoops of various types have long been used on farms and elsewhere for an infinite varieties of purposes. Generally, these scoops are hinged to a frame which allows them to pivot at various angles to dump the contents or to scrape or grade the ground. The hydraulic lift arms of the tractor are used to raise and lower the scoop and the dumping mechanism generally allows the scoop to pivot about its lower portion to thereby empty its contents. Tractor scoop mechanisms in the past have often times been difficult to operate, especially when a scoop has been fully loaded. Also, prior art mechanisms have caused difficulty when the functioning components become bent or distorted thereby being impossible to operate with any effectiveness or efficiency.

With this background in mind the present invention was developed and one of its objectives is to provide a tractor scoop mechanism which is durable and easy to operate under loaded conditions.

Another objective of the present invention is to provide a scoop mechanism which includes a rotatable locking pin.

It is another objective of the present invention to provide a tractor scoop mechanism which allows for ease in manual operation and release of the scoop even when the scoop is filled with gravel or other heavy materials.

It is still another objective of the present invention to provide a scoop mechanism which is easy to construct and economical to manufacture.

SUMMARY OF THE PREFERRED EMBODIMENT

The tractor scoop mechanism of the preferred embodiment includes a frame member which can be pivotably attached to a scoop device and includes a handle means joined to a pin assembly. The pin assembly is rotated by the handle means, causing the scoop locking pins to rotate from an engaged to a disengaged position. In the preferred embodiment two locking pins are utilized, one pin being joined to the outer section of the telescoping portion of the pin assembly and the other pin being joined to the inner section. As the handle is pulled causing the locking pins to rotate from an engaged to a disengaged position, the telescoping portion collapses due to camming fingers following camming faces of pin housing means which are attached to the frame member. The camming face of the pin housing of the preferred embodiment also includes a depression which allows the pin assembly to "lock" in its fully retracted or disengaged position.

The preferred embodiment of the invention also includes a release lever located on the pin assembly which, when struck by the scoop mechanism, causes the pin assembly to rotate from a disengaged to an engaged position thereby securing the scoop in a stationary posture.

DESCRIPTION OF THE DRAWINGS

FIG. 1 demonstrates the tractor scoop mechanism of the present invention in use;

FIG. 2 demonstrates the tractor scoop mechanism apart from a tractor in a slightly opened position with the tractor scoop;

FIG. 3 demonstrates the tractor scoop mechanism in a more fully opened position relative to the tractor scoop;

FIG. 4 demonstrates the tractor scoop mechanism as it would appear in a fully engaged position with the tractor scoop;

FIG. 5 demonstrates a top cross sectional view of FIG. 4;

FIG. 6 demonstrates a fragmented view of the tractor scoop mechanism in its disengaged position;

FIG. 7 demonstrates a top cross sectional view of FIG. 6;

FIG. 8 illustrates a top cross sectional view of the pin assembly of the present invention.

For a more detailed description of the drawings, FIG. 1 illustrates tractor 10 with rear scoop 11 attached thereto. Tractor scoop mechanism 12 is shown connected to tractor 10 by hydraulic lift arm 13 and center stabilizing member 14.

Scoop mechanism 12 is shown in FIG. 2 with handle means 15 depressed and frame member 16 pivoting away from scoop 11. When the handle means 15 is pulled in a downward direction, locking pin members 17 and 18 of pin assembly 19 as shown in FIG. 4 and 5 retract, allowing the scoop 11 to fall to a dumping posture.

FIGS. 6 and 7 demonstrate locking pin members 17 and 18 in a retracted or withdrawn position as would occur with handle means 15 fully depressed. FIG. 3 shows tractor scoop mechanism 12 unattached to a tractor in an opened position with latch members 20 having openings therein for reception of pin members 17 and 18. Also shown in FIG. 3 is release member 21 attached to pin assembly 19. Release member 21 contacts scoop stud 22 as frame member 16 pivots to a closed position thereby causing pin assembly 19 to rotate with pin members 17 and 18 again engaging latch members 20. Frame member 16 pivots about pivot pins 23 and 24 as shown in FIG. 4. Also shown in FIG. 4 is hitching means 25 which pivotally joins to center stabilizing member 14 as shown in FIG. 1. Hitching means 25 can be procured in a stabilizing position as shown in FIG. 4 by securing means 36 but during normal operation of scoop 11 hitching means 25 is allowed to pivot freely attached to center stabilizing member 14 and scoop 11.

The rotational action of pin members 17 and 18 allows handle means 15 to be manually depressed with ease even when scoop 11 is loaded with gravel or other heavy materials. The rotation of pin assembly 19 results from camming fingers 26 and 27 following camming faces 28 and 29 respectively of pin housing members 30 and 31 as shown in FIG. 8. In the engaged position with handle means 15 being upright, pin members 17 and 18 are extended as shown in FIG. 5. Also as shown in FIG. 5 camming fingers 26 and 27 are fully extended. As handle means 15 is urged downwardly camming fingers 26 and 27 follow camming faces 28 and 29 of pin housing members 30 and 31 respectively causing pin assembly 19 to collapse in telescoping fashion with inner telescoping section 32 compressing resilient member 33 which may be a coil spring as shown in FIG. 8 which is positioned in outer telescoping section 34. Thus, a telescoping portion 35 of pin assmebly 19 allows pin members 17 and 18 to withdraw or retract when handle means 15 is depressed. Conversely when handle means 15 returns to its upright position pin members 17 and 18 extend to engage latch members 20 to secure scoop 11 in a fixed position.

The rotational movement of pins 17 and 18 greatly facilitate the disengagement of pin members 17 and 18 from latch members 20 such as when a load of dense material is carried by scoop 11.

The examples and illustrations contained herein are for demonstrative purposes and are not intended to limit the scope of the invention.

I claim:

1. A tractor scoop mechanism comprising: a frame member for pivotable attachment to a scoop device, a pin assembly for engagement with and disengagement from said scoop device, said pin assembly mounted on said frame member, a handle means, said handle means affixed to said pin assembly, said pin assembly having a telescoping portion having inner and outer sections, said outer section containing a resilient member, said inner section and said outer section each having a pin member whereby said telescoping portion is in a collapsed configuration when said pin assembly is in a disengaged position.

2. A tractor scoop mechanism as claimed in claim 1 wherein aid telescoping portion includes a camming finger.

3. A tractor scoop mechanism as claimed in claim 1 wherein said frame member includes a pin housing means.

4. A tractor scoop mechanism as claimed in claim 3 wherein said pin housing means includes a camming face.

5. A tractor scoop mechanism as claimed in claim 1 wherein said pin assembly includes a telescoping portion having a camming finger, said frame member includes a pin housing means, said pin housing means having a camming face, said camming finger being contiguous with said camming face whereby rotating said handle means causes said camming finger to follow said camming face.

6. A tractor scoop mechanism as claimed in claim 1 wherein said frame member includes a pivotable hitching means.

7. A tractor scoop mechanism as claimed in claim 1 wherein said pin assembly includes a release member.

* * * * *